US007852288B2

(12) United States Patent
Onozawa

(10) Patent No.: US 7,852,288 B2
(45) Date of Patent: Dec. 14, 2010

(54) PLASMA DISPLAY APPARATUS WITH IMPROVEMENT IN SUPPLY OF SUSTAIN VOLTAGE

(75) Inventor: Makoto Onozawa, Yokohama (JP)

(73) Assignee: Fujitsu Hitachi Plasma Display Limited, Miyazaki (JP)

( * ) Notice: Subject to any disclaimer, the term of this patent is extended or adjusted under 35 U.S.C. 154(b) by 936 days.

(21) Appl. No.: 11/698,205

(22) Filed: Jan. 26, 2007

(65) Prior Publication Data

US 2008/0007490 A1 Jan. 10, 2008

(30) Foreign Application Priority Data

Jul. 6, 2006 (JP) ..... 2006-187100

(51) Int. Cl.
*G09G 3/28* (2006.01)

(52) U.S. Cl. ..... 345/60; 345/68; 345/211; 345/212

(58) Field of Classification Search ..... 345/60, 345/68, 211, 212
See application file for complete search history.

(56) References Cited

U.S. PATENT DOCUMENTS 6,803,892 B2 * 10/2004 Roh et al. ..... 345/87
6,995,521 B2 * 2/2006 Okamura et al. ..... 315/169.4
2006/0268511 A1 * 11/2006 Jeong ..... 361/690
2006/0289429 A1 * 12/2006 Jeong ..... 219/388

FOREIGN PATENT DOCUMENTS

JP 2003-302932 10/2003
KR 1020060124040 A 12/2006

OTHER PUBLICATIONS

Korean Office Action, issued in Korean Patent Application No. 10-2007-0010668, dated on Jan. 28, 2008.

* cited by examiner

*Primary Examiner*—Quan-Zhen Wang
*Assistant Examiner*—Sahlu Okebato
(74) *Attorney, Agent, or Firm*—McDermott Will & Emery LLP

(57) ABSTRACT

A plasma display apparatus includes a display panel in which display cells are constituted at least by a set of electrodes including first electrodes extending in a first direction, second electrodes extending in the first direction, and third electrodes extending in a second direction substantially perpendicular to the first direction, a first drive circuit configured to drive the first electrodes, a second drive circuit configured to drive the second electrodes, a third drive circuit configured to drive the third electrodes in conjunction with successive scanning of the first electrodes, and a power-supply circuit configured to generate a DC voltage based on an AC voltage and to supply the DC voltage to the first drive circuit and the second drive circuit, wherein the power-supply circuit and a given drive circuit that is one of the first drive circuit and the second drive circuit are implemented on a single print circuit board.

2 Claims, 11 Drawing Sheets

PLASMA DISPLAY APPARATUS WITH IMPROVEMENT IN SUPPLY OF SUSTAIN VOLTAGE

BACKGROUND OF THE INVENTION

1. Field of the Invention

The present invention generally relates to an image display apparatus, and particularly relates to a plasma display apparatus.

2. Description of the Related Art

A plasma display panel has two glass substrates which have electrodes formed thereon and define a space therebetween that is filled with discharge gas, and generates electric discharge by applying voltages between the electrodes so as to induce light emission from fluorescent substance provided on the substrates in response to the ultraviolet light generated by the electric discharge, thereby displaying an image. Plasma display panels are widely used as large-screen display apparatuses due to the facts that a large-sized screen is easy to make, that the self-light-emission nature ensures high display quality, and that the response speed is high.

On a display panel, X electrodes and Y electrodes extending in parallel are formed, and address electrodes are provided to run perpendicularly to the X and Y electrodes. The X and Y electrodes serve to generate sustain discharges for display-purpose light emission. The sustain discharges are generated by applying voltage pulses repeatedly between the X electrodes and the Y electrode. The Y electrodes also serve as scan electrodes for use in the writing of display data. The address electrodes serve to select discharge cells that emit light, and apply address-voltage pulses responsive to display data in order to generate write discharge for selecting the discharge cells between the Y electrodes and the address electrodes.

FIG. 1 is a block diagram showing a main part of a related-art plasma display apparatus. A plasma display apparatus shown in FIG. 1 includes a plasma display panel 11, an address-electrode drive circuit 12, a Y-electrode drive circuit 13, an X-electrode drive circuit 14, a scan circuit 15, a drive control circuit 16, a signal processing circuit 17, and an AC/DC power supply circuit 18.

The signal processing circuit 17 receives a clock signal, display data, a vertical synchronizing signal, a horizontal synchronizing signal, etc., which are supplied from an external source, and performs various tasks such as the writing of RGB display data to a frame memory in response to the vertical synchronizing signal. The drive control circuit 16 controls the address-electrode drive circuit 12, the Y-electrode drive circuit 13, the X-electrode drive circuit 14, and the scan circuit 15 to display the display data stored in the frame memory on the plasma display panel 11.

Specifically, the drive control circuit 16 generates address control signals responsive to the display data in the frame memory in synchronization with the clock signal. The address control signals are supplied to the address-electrode drive circuit 12. The drive control circuit 16 further generates scan driver control signals for controlling the scan circuit 15 in synchronization with the vertical synchronizing signal and the horizontal synchronizing signal. The scan driver control signals are supplied to the scan circuit 15. The drive control circuit 16 further drives the Y-electrode drive circuit 13 and the X-electrode drive circuit 14 in synchronization with the vertical synchronizing signal and the horizontal synchronizing signal.

The address-electrode drive circuit 12 applies address-voltage pulses responsive to the display data to address electrodes A1 through Am in synchronization with the clock signal. The Y-electrode drive circuit 13 drives Y electrodes Y1 through Yn independently of each other via the scan circuit 15. The X-electrode drive circuit 14 drives X electrodes X1 through Xn all together.

Through the operations of the address-electrode drive circuit 12, the Y-electrode drive circuit 13, the X-electrode drive circuit 14, and the scan circuit 15, each display pixel is initialized in a reset period, followed by an address period in which pixels to be displayed are selected, and, in a sustain period that comes last, the selected pixels are caused to emit light.

In the reset period, a reset/address-voltage generating circuit inside the Y-electrode drive circuit 13 generates a reset voltage, so that the scan circuit 15 applies the reset voltage to all the Y electrodes Y1 through Yn. Further, a reset voltage generated by a reset/address-voltage generating circuit inside the X-electrode drive circuit 14 is applied to all the X electrodes X1 through Xn.

In the address period, the scan circuit 15 drives the Y electrodes Y1 through Yn successively one by one based on the address voltage generated by the reset/address-voltage generating circuit of the Y-electrode drive circuit 13, and, in conjunction therewith, the address-electrode drive circuit 12 applies address-voltage pulses for one horizontal line responsive to the display data to the address electrodes A1 through Am. Cells to be displayed are selected in this manner, thereby controlling the display/non-display (selection/non-selection) of each display cell (pixel).

In the sustain period, sustain voltage pulses generated by a sustain-pulse circuit of the Y-electrode drive circuit 13 are applied to the Y electrodes Y1 through Yn via the scan circuit 15, and sustain voltage pulses generated by a sustain-pulse circuit of the X-electrode drive circuit 14 are applied to the X electrodes X1 through Xn. The application of these sustain voltage pulses generates sustain discharge between an X electrode and a Y electrode at the cells selected as display cells. These sustain voltage pulses are generated based on a sustain voltage VS0. The AC/DC power supply circuit 18 converts a commercial AC power supply voltage into a DC power supply voltage, which is supplied as the sustain voltage VS0 to the X-electrode drive circuit 14 via an electric cable 18*a*. Further, the sustain voltage VS0 is supplied from the X-electrode drive circuit 14 to the Y-electrode drive circuit 13 via an electric cable 18 *b*.

FIG. 2 is a drawing showing an example of the configuration of the related-art AC/DC power supply circuit 18. The AC/DC power supply circuit 18 includes a rectifying circuit 21, a pulse generating circuit 22, a transformer 23, a diode 24, a light-emission device 25, a light-detection device 26, a smoothing condenser Cvs0, and resistors R1 and R2 serving as a voltage detection circuit.

The rectifying circuit 21 rectifies an AC voltage supplied from a commercial AC power supply, and supplies the rectified voltage to the pulse generating circuit 22. The pulse generating circuit 22 generates a rectangular-pulse voltage waveform based on the rectified voltage supplied from the rectifying circuit 21. This pulse voltage waveform causes an electric current to be generated at the output terminal of the transformer 23. This electric current flows into the smoothing condenser Cvs0 through the diode 24, thereby charging the smoothing condenser Cvs0. A voltage between the opposite ends of the smoothing condenser Cvs0 is divided by the resistors R1 and R2, so that the light-emission device 25 emits light with intensity responsive to the divided voltage level. The light-detection device 26 receives light from the light-emission device 25, and supplies a signal responsive to the intensity of the received light to the pulse generating circuit 22. The pulse generating circuit 22 controls the generation of the pulses in response to the signal from the light-detection device 26. This feedback control serves to adjust the voltage between the opposite ends of the smoothing condenser Cvs0 to a predetermined voltage (i.e., to the sustain discharge voltage VS0).

The transformer 23 transmits an electric power from the primary side to the secondary side via changes in magnetic flux, so that the input side and output side of the transformer 23 are not electrically connected with each other (i.e., not directly connected through an electrical conductor). An optical coupling unit 27 comprised of the light-emission device 25 and the light-detection device 26 transmits information from the input side to the output side via changes in light intensity, so that the input side and output side are not electrically connected with each other (i.e., not directly connected through an electrical conductor). In this manner, the primary side and the secondary side are electrically insulated from each other.

FIG. 3 is a drawing showing an example of the circuit configuration of the related-art X-electrode drive circuit 14. The X-electrode drive circuit 14 includes an energy-supply-purpose condenser Cvs1, power MOS-field-effect transistors Q1 through Q4, diodes D1 and D2, inductors L1 and L2, and a charge-collection-purpose condenser C1. An illustrated capacitance Cp1 represents the capacitance of the plasma display panel 11, and, in particular, is the capacitance of the X electrodes of the plasma display panel 11. What is shown in FIG. 3 is a portion corresponding to the sustain circuit for generating sustain discharges that is provided in the X-electrode drive circuit 14. The X-electrode drive circuit 14 further includes circuit portions for supplying the reset voltage and the like, which are omitted in FIG. 3.

At the initial stage of the performing of sustain discharge, the capacitor Cp1 has no electric charge accumulated therein and is placed at the ground potential while the charge-collection-purpose condenser C1 has accumulated electric charge and exhibits a voltage of about VS0/2. In this state, the power MOS-field-effect transistor Q3 is turned on to become conductive, so that the electric charge of the charge-collection-purpose condenser C1 flows into the capacitor Cp1 via the diode D1 and the inductor L1. As a result, the capacitor Cp1 exhibits a voltage of about VS0 through the resonance of the inductor L1 and the capacitor Cp1. Thereafter, in order to maintain the X electrodes of the plasma display panel 11 at a constant voltage, the power MOS-field-effect transistor Q1 is turned on to supply the voltage VS0 from the energy-supply-purpose condenser Cvs1 to the plasma display panel 11. Consequently, sustain discharge is generated. Here, the energy-supply-purpose condenser Cvs1 receives the sustain-discharge voltage VS0 supplied from the AC/DC power supply circuit 18.

After this, the power MOS-field-effect transistor Q1 is turned off, and the power MOS-field-effect transistor Q4 is turned on, so that electric charge flows into the charge-collection-purpose condenser C1 from the capacitor Cp1 via the inductor L2 and the diode D2. With this arrangement, the electric charge that has been used to charge the capacitor Cp1 of the plasma display panel 11 can be collected. The power MOS-field-effect transistor Q2 is then turned on to remove the electric charge of Cp1 remaining after the collection, thereby setting the X electrodes to the ground potential.

FIG. 4 is a drawing showing a connection between the X-electrode drive circuit 14 and the AC/DC power supply circuit 18 in the related-art configuration. In FIG. 4, the same elements as those of FIGS. 1 through 3 are referred to by the same numerals, and a description thereof will be omitted.

The AC/DC power supply circuit 18 is implemented on an AC/DC-power-supply circuit board 31. The X-electrode drive circuit 14 is implemented on an X-electrode-drive circuit board 32. The AC/DC-power-supply circuit board 31 and the X-electrode-drive circuit board 32 are separate boards, and the AC/DC power supply circuit 18 and the X-electrode drive circuit 14 on the respective boards are connected with each other via the electric cable 18*a*.

In such a configuration, proper handling and storing of the electric cable 18*a* are necessary, and, also, a thick cable is required to supply a high voltage (VS0), which results in a cost increase. Further, since a voltage drop occurs when an electric current runs through the electric cable 18*a*, there is a need to provide the energy-supply-purpose condenser Cvs1 with a large capacity in the X-electrode drive circuit 14, which results in a need for a large circuit-board area.

FIG. 5 is a drawing showing the arrangement of circuits of a related-art plasma display apparatus. What is shown in FIG. 3 is the plasma display panel 11 as viewed from the rear. Various circuits are arranged on the backside (i.e., opposite the display screen side) of the plasma display panel 11.

The drive control circuit 16, the signal processing circuit 17, and the AC/DC power supply circuit 18 are arranged around the center of the plasma display panel 11, and the X-electrode drive circuit 14 and the Y-electrode drive circuit 13 are arranged on the opposite sides of the plasma display panel 11 in such a manner as to keep balance. The address-electrode drive circuit 12 is arranged at the bottom of the plasma display panel 11. The AC/DC power supply circuit 18 positioned at around the center supplies a power supply voltage to the X-electrode drive circuit 14 via the electric cable 18*a*. Further, the power supply voltage is supplied from the X-electrode drive circuit 14 to the Y-electrode drive circuit 13 via the electric cable 18 *b*.

In the related-art configuration, there is a need to arrange the Y-electrode drive circuit 13, the X-electrode drive circuit 14, and the AC/DC power supply circuit 18 in such a manner as to keep proper balance between the left-hand side and the right-hand side as shown in FIG. 5 because these circuits are large and heavy. To this end, the required arrangement is such that the AC/DC power supply circuit 18 is positioned at the center, and supplies the power supply voltage via electric cables to the Y-electrode drive circuit 13 and the X-electrode drive circuit 14 positioned on the opposite sides, respectively. This arrangement, however, leads to a cost increase since a thick electric cable is necessary for the purpose of supplying a high voltage as previously described, and also requires a large circuit-board area since a voltage drop occurring upon the flowing of an electric current through the electric cable 18*a* necessitates the provision of the energy-supply-purpose condenser Cvs1 with a large capacity in the X-electrode drive circuit 14.

Moreover, there has been a trend in recent years for plasma display panels to have an increased panel size in response to the demand for large-size screen display, which results in a further increase in the length of the electric cable 18*a*.

[Patent Document 1] Japanese Patent Application Publication No. 2003-302932

Accordingly, there is a need for a plasma display apparatus for which the cost of an electric cable required to supply a power is reduced, and for which the problem of a voltage drop occurring upon the flowing of an electric current through the electric cable is obviated.

SUMMARY OF THE INVENTION

It is a general object of the present invention to provide a plasma display apparatus that substantially obviates one or more problems caused by the limitations and disadvantages of the related art.

Features and advantages of the present invention will be presented in the description which follows, and in part will become apparent from the description and the accompanying drawings, or may be learned by practice of the invention according to the teachings provided in the description. Objects as well as other features and advantages of the present invention will be realized and attained by a plasma display apparatus particularly pointed out in the specification in such full, clear, concise, and exact terms as to enable a person having ordinary skill in the art to practice the invention.

To achieve these and other advantages in accordance with the purpose of the invention, the invention provides a plasma display apparatus, which includes a display panel in which display cells are constituted at least by a set of electrodes including first electrodes extending in a first direction, second electrodes extending in the first direction, and third electrodes extending in a second direction substantially perpendicular to the first direction, a first drive circuit configured to drive the first electrodes, a second drive circuit configured to drive the second electrodes, a third drive circuit configured to drive the third electrodes in conjunction with successive scanning of the first electrodes, and a power-supply circuit configured to generate a DC voltage based on an AC voltage and to supply the DC voltage to the first drive circuit and the second drive circuit, wherein the power-supply circuit and a given drive circuit that is one of the first drive circuit and the second drive circuit are implemented on a single print circuit board.

According to another aspect of the present invention, a plasma display apparatus includes a display panel in which display cells are constituted at least by a set of electrodes including first electrodes extending in a first direction, second electrodes extending in the first direction, and third electrodes extending in a second direction substantially perpendicular to the first direction, a first drive circuit configured to drive the first electrodes, a second drive circuit configured to drive the second electrodes, a third drive circuit configured to drive the third electrodes in conjunction with successive scanning of the first electrodes, and a power-supply circuit configured to generate a DC voltage based on an AC voltage and to supply the DC voltage to the first drive circuit and the second drive circuit, a first print circuit board on which the power-supply circuit is implemented, and a second print circuit board on which a given drive circuit that is one of the first drive circuit and the second drive circuit is implemented, wherein the first print circuit board and the second print circuit board are placed side by side and connected via a circuit-board connector.

According to at least one embodiment of the present invention, the voltage generated by the power-supply circuit is supplied to the given drive circuit via printed wiring on the circuit board or via a circuit-board connector. The length of the printed wiring or the circuit-board connector is substantially shorter than the length of a related-art electric cable, so that a voltage drop caused by the flowing of an electric current can be ignored. Accordingly, the cost of an electric cable required to supply a power is reduced, and the problem of a voltage drop occurring upon the flowing of an electric current through this electric cable is obviated.

BRIEF DESCRIPTION OF THE DRAWINGS

Other objects and further features of the present invention will be apparent from the following detailed description when read in conjunction with the accompanying drawings, in which.

DESCRIPTION OF THE PREFERRED EMBODIMENTS

In the following, embodiments of the present invention will be described with reference to the accompanying drawings.

Figure 1:
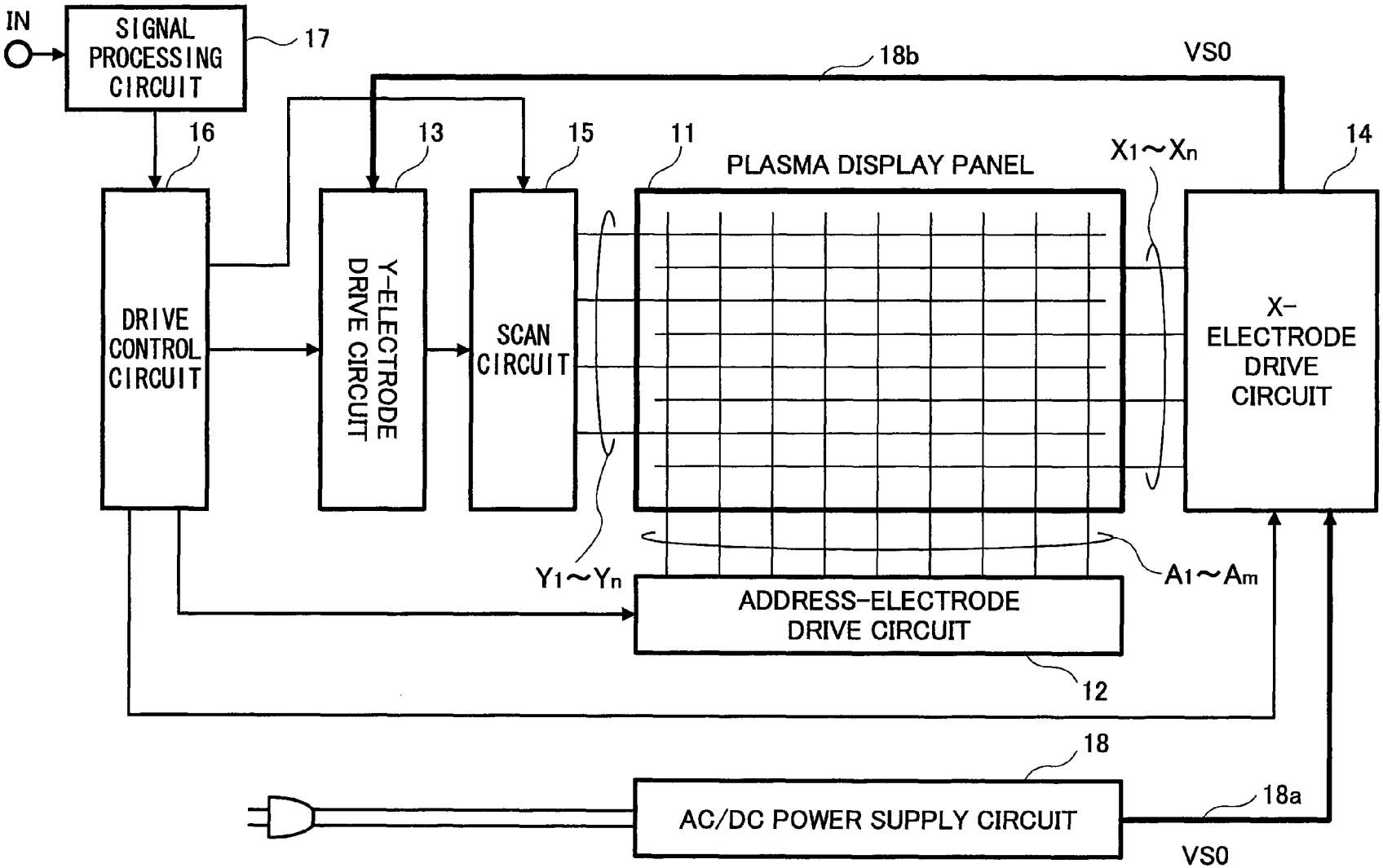
FIG.1 RELATED ART
FIG. 1 is a block diagram showing a main part of a related-art plasma display apparatus.
Figure 6:
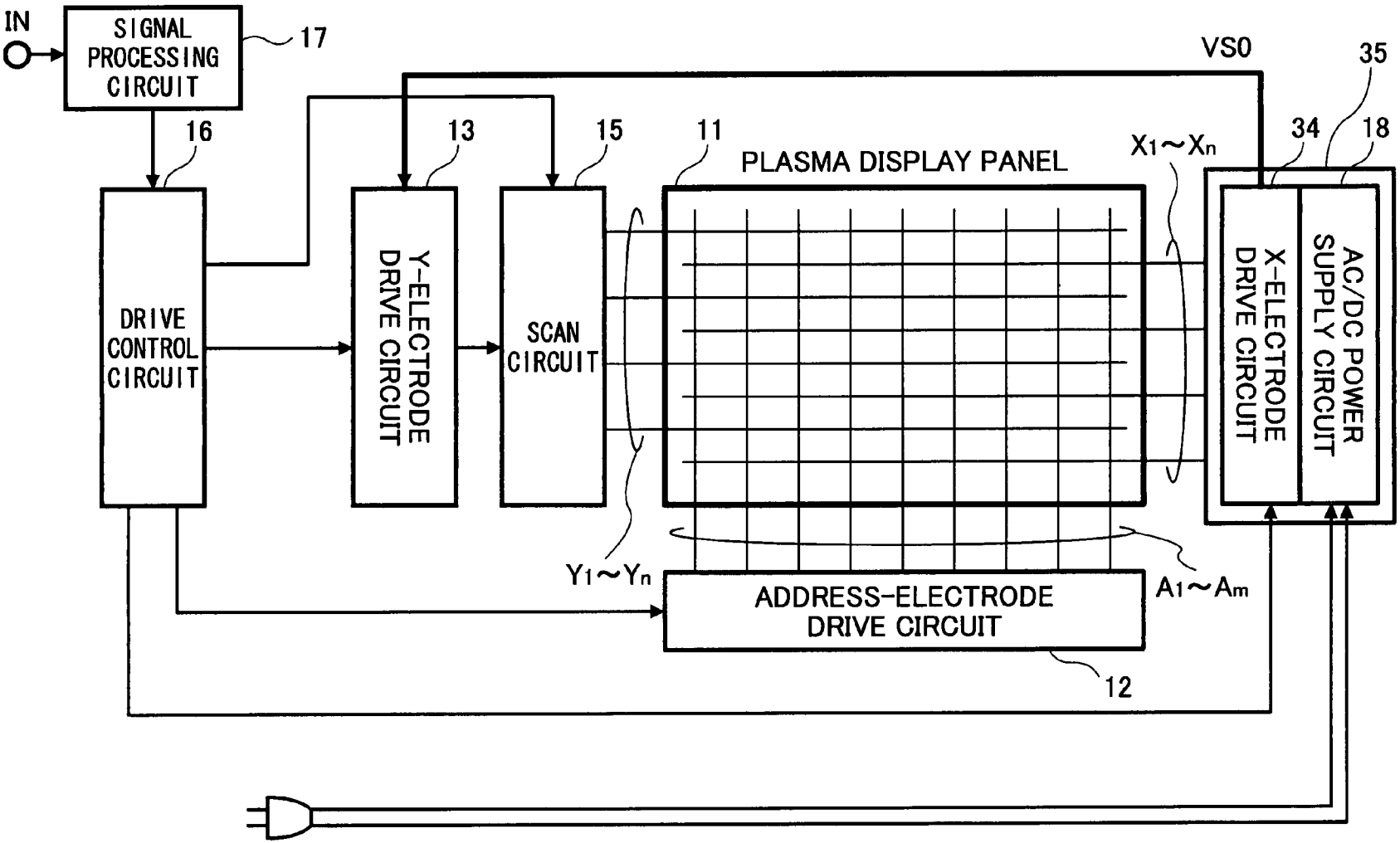
FIG. 6 is a block diagram showing a main portion of a first embodiment of a plasma display apparatus according to the present invention.

FIG. 6 is a block diagram showing a main portion of a first embodiment of a plasma display apparatus according to the present invention. A plasma display apparatus shown in FIG. 6 includes a plasma display panel 11, an address-electrode drive circuit 12, a Y-electrode drive circuit 13, an X-electrode drive circuit 34, a scan circuit 15, a drive control circuit 16, a signal processing circuit 17, and an AC/DC power supply circuit 18. In FIG. 6, the same elements as those of FIG. 1 are referred to by the same numerals, and a description thereof will be omitted.

In the plasma display apparatus shown in FIG. 6, the X-electrode drive circuit 34 is provided in place of the X-electrode drive circuit 14, and the X-electrode drive circuit 34 and the AC/DC power supply circuit 18 are implemented on the same circuit board (print circuit board) 35. The provision of the X-electrode drive circuit 34 and the AC/DC power supply circuit 18 on the same circuit board 35 eliminates the need for an electric cable that connects between these two circuits.

The configuration and operation of the plasma display panel 11, the address-electrode drive circuit 12, the Y-electrode drive circuit 13, the scan circuit 15, the drive control circuit 16, and the signal processing circuit 17 shown in FIG. 6 are the same as the configuration and operation described in connection with FIG. 1.

Figure 4:
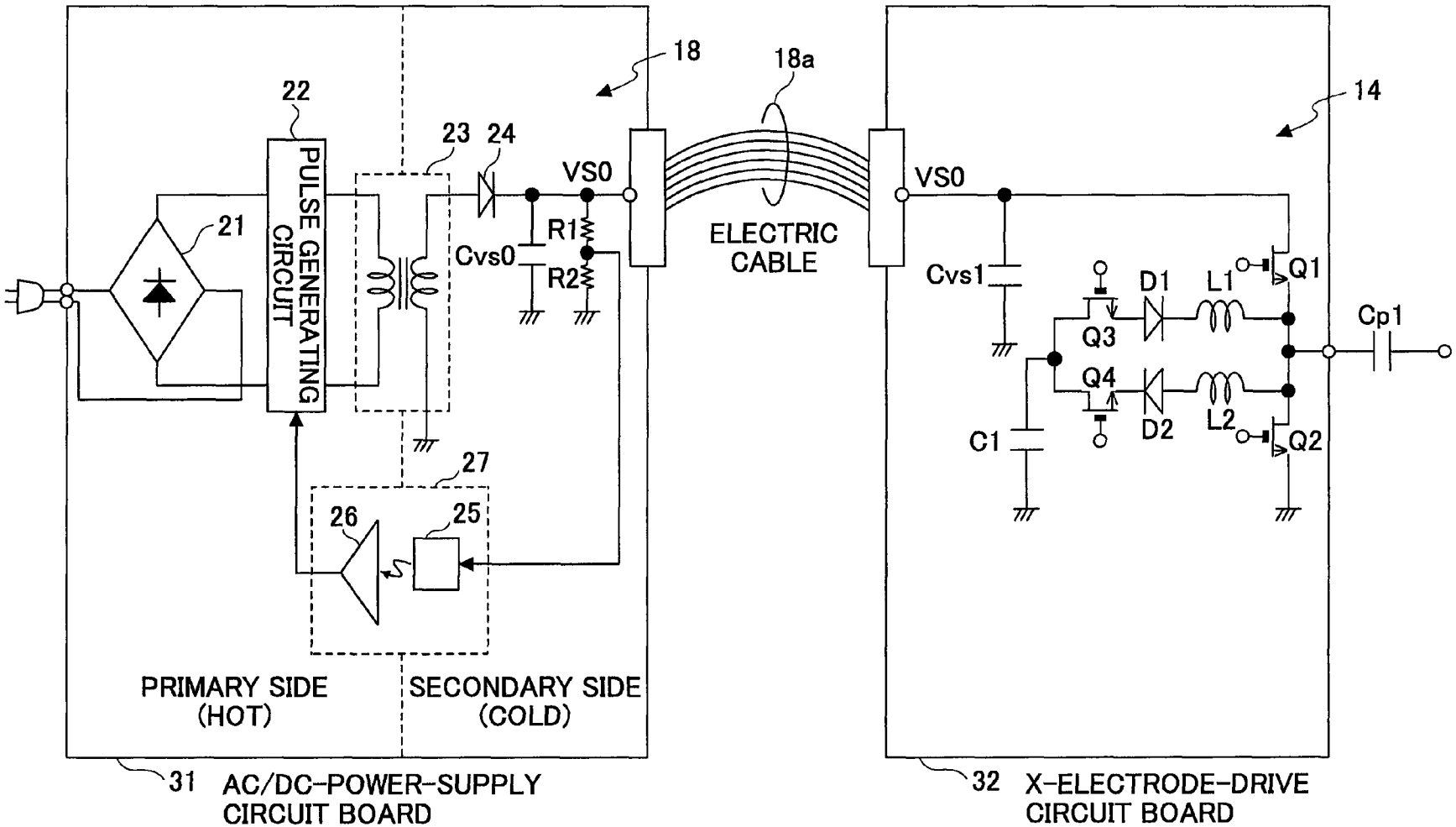
FIG.4 RELATED ART
FIG. 4 is a drawing showing a connection between the X-electrode drive circuit and the AC/DC power supply circuit in the related-art configuration.
Figure 5:
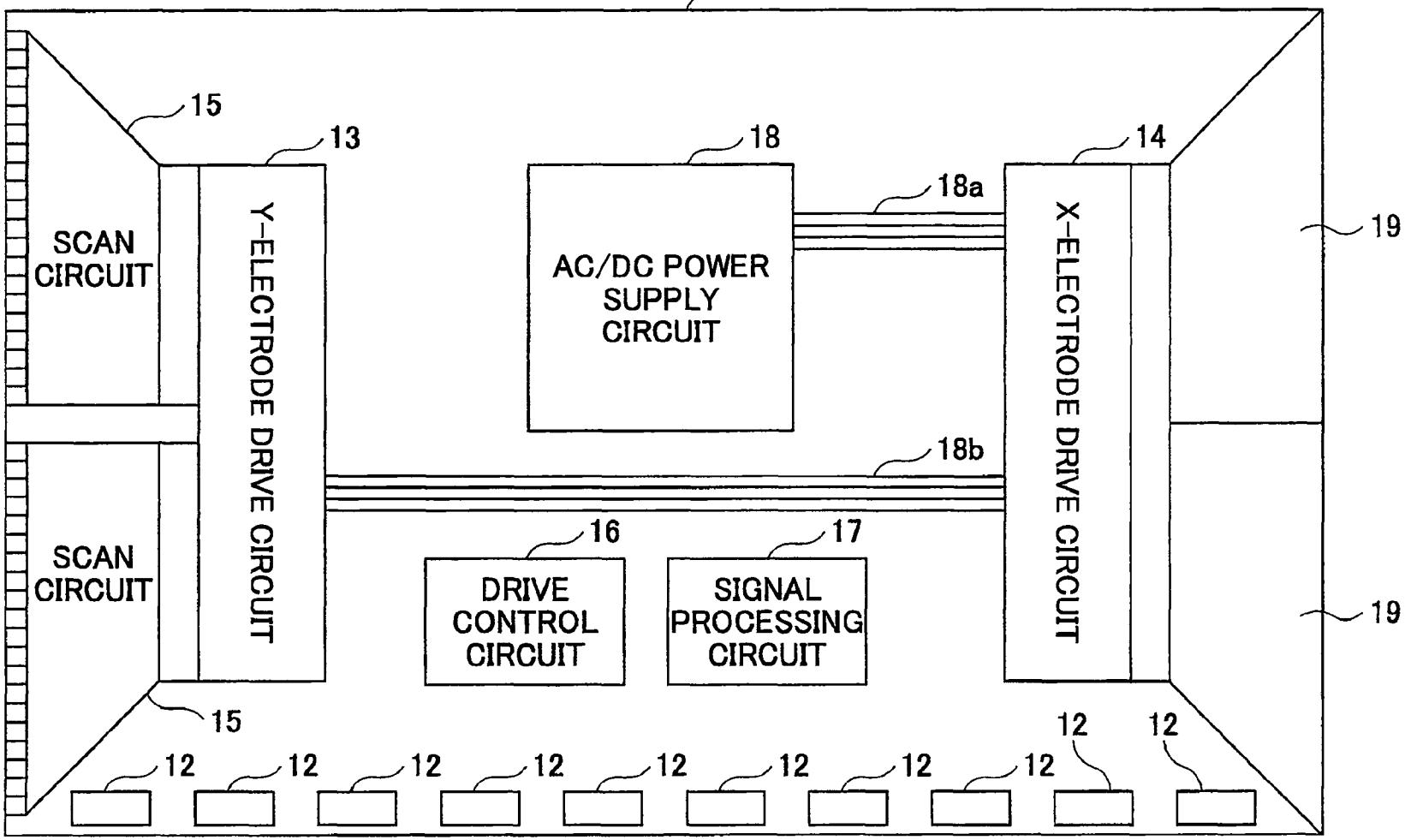
FIG.5 RELATED ART
FIG. 5 is a drawing showing the arrangement of circuits of a related-art plasma display apparatus.
Figure 7:
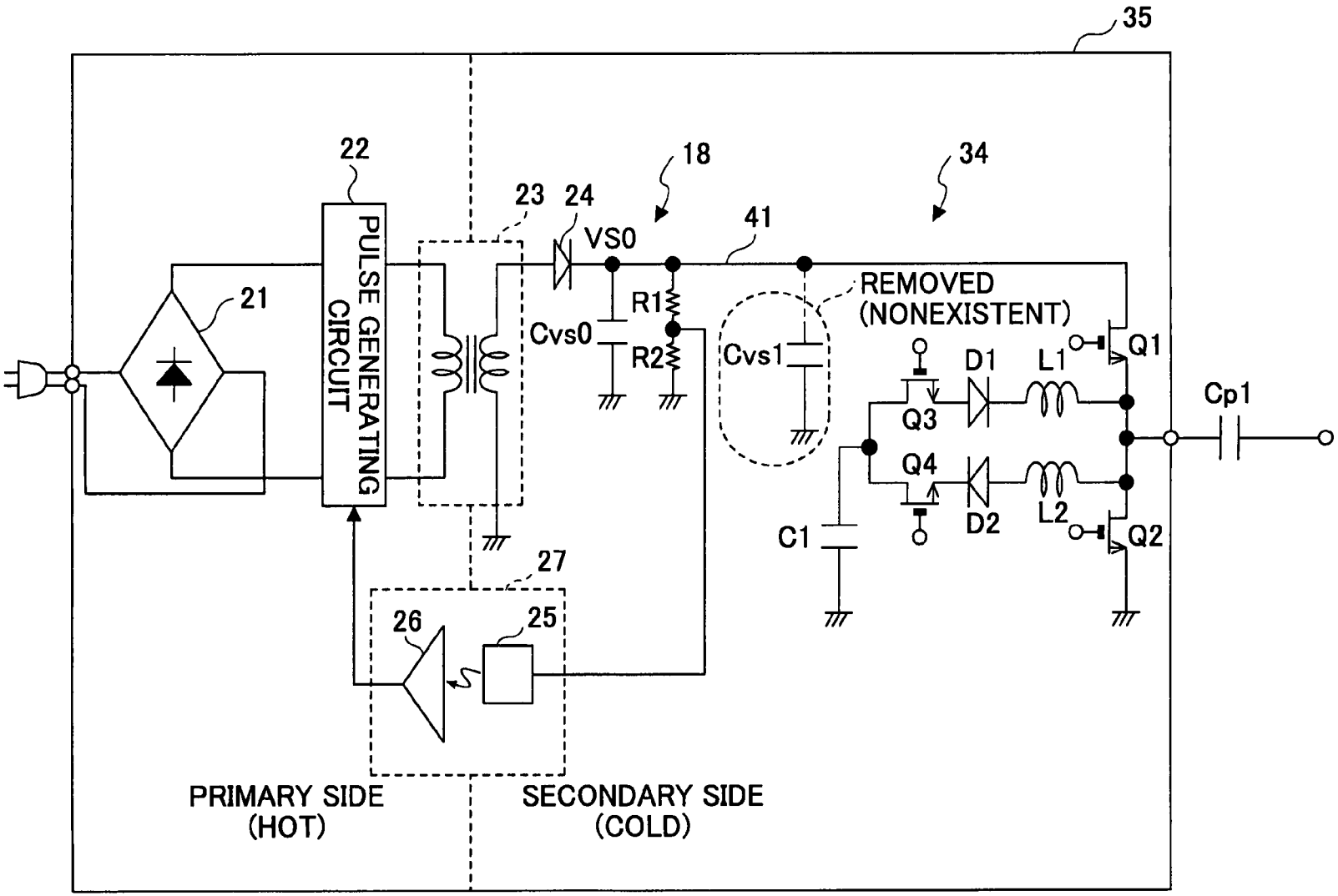
FIG. 7 is a drawing showing an X-electrode drive circuit and an AC/DC power supply circuit implemented on the same circuit board.

FIG. 7 is a drawing showing the X-electrode drive circuit 34 and the AC/DC power supply circuit 18 implemented on the circuit board 35. In FIG. 7, the same elements as those of FIG. 4 are referred to by the same numerals, and a description thereof will be omitted.

Since the AC/DC power supply circuit 18 and the X-electrode drive circuit 34 are implemented on the same circuit board 35, the voltage VS0 generated by the AC/DC power supply circuit 18 is supplied to the X-electrode drive circuit 34 via printed wiring 41 on the circuit board 35. The length of the printed wiring 41 is substantially shorter than the length of the related-art electric cable 18*a*, so that the voltage drop of the voltage VS0 caused by an electric current running through the printed wiring 41 can be ignored.

The X-electrode drive circuit 34 has the same circuit configuration as the X-electrode drive circuit 14, except that the energy-supply-purpose condenser Cvs1 is removed. Since the voltage drop along the printed wiring 41 can almost completely be ignored in this case, the condenser Cvs0 provided in the AC/DC power supply circuit 18 can be utilized as an energy-supply-purpose condenser, so that there is no need to provide another energy-supply-purpose condenser in the X-electrode drive circuit 34.

Figure 2:
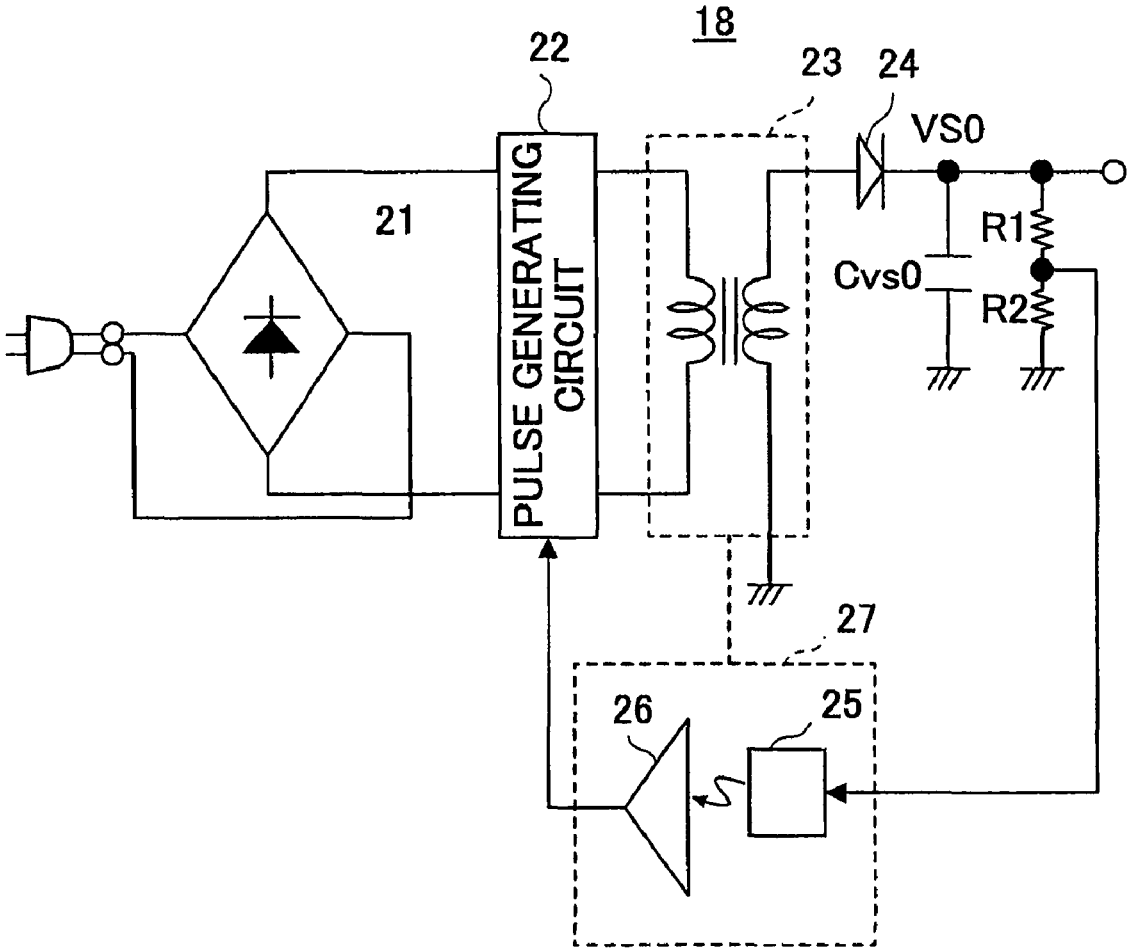
FIG.2 RELATED ART
FIG. 2 is a drawing showing an example of the configuration of a related-art AC/DC power supply circuit.
Figure 3:
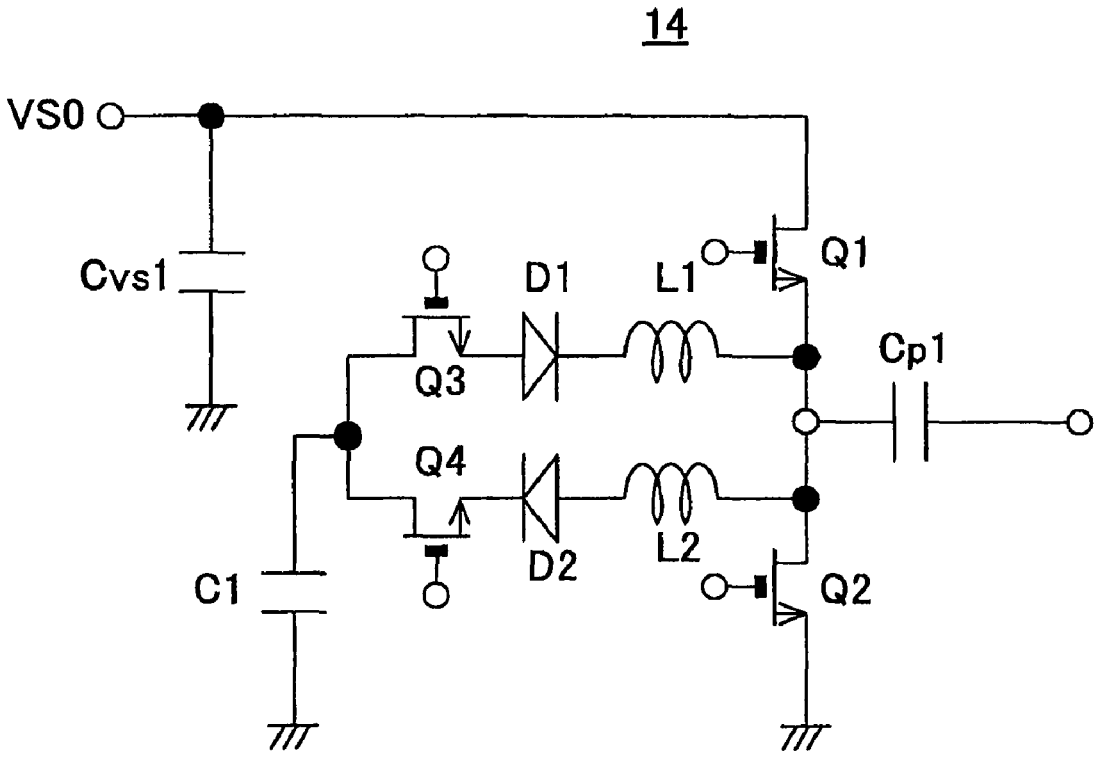
FIG.3 RELATED ART
FIG. 3 is a drawing showing an example of the circuit configuration of a related-art X-electrode drive circuit.

The circuit configuration and operation of the AC/DC power supply circuit 18 are the same as the circuit configuration and operation described in connection with FIG. 2. The circuit configuration and operation of the X-electrode drive circuit 34 are the same as the circuit configuration and operation described in connection with FIG. 3, except that the condenser Cvs0 is used as an energy-supply-purpose condenser.

Further, the transformer 23 transmits an electric power from the primary side to the secondary side via changes in magnetic flux (magnetic coupling), so that the input side and output side of the transformer 23 are not electrically connected with each other (i.e., not directly connected through an electrical conductor). Also, the optical coupling unit 27 comprised of the light-emission device 25 and the light-detection device 26 transmits information from the input side to the output side via changes in light intensity (optical coupling), so that the input side and output side are not electrically connected with each other (i.e., not directly connected through an electrical conductor). In this manner, the primary side (hot side) and the secondary side (cold side) are electrically insulated from each other.

Figure 8:
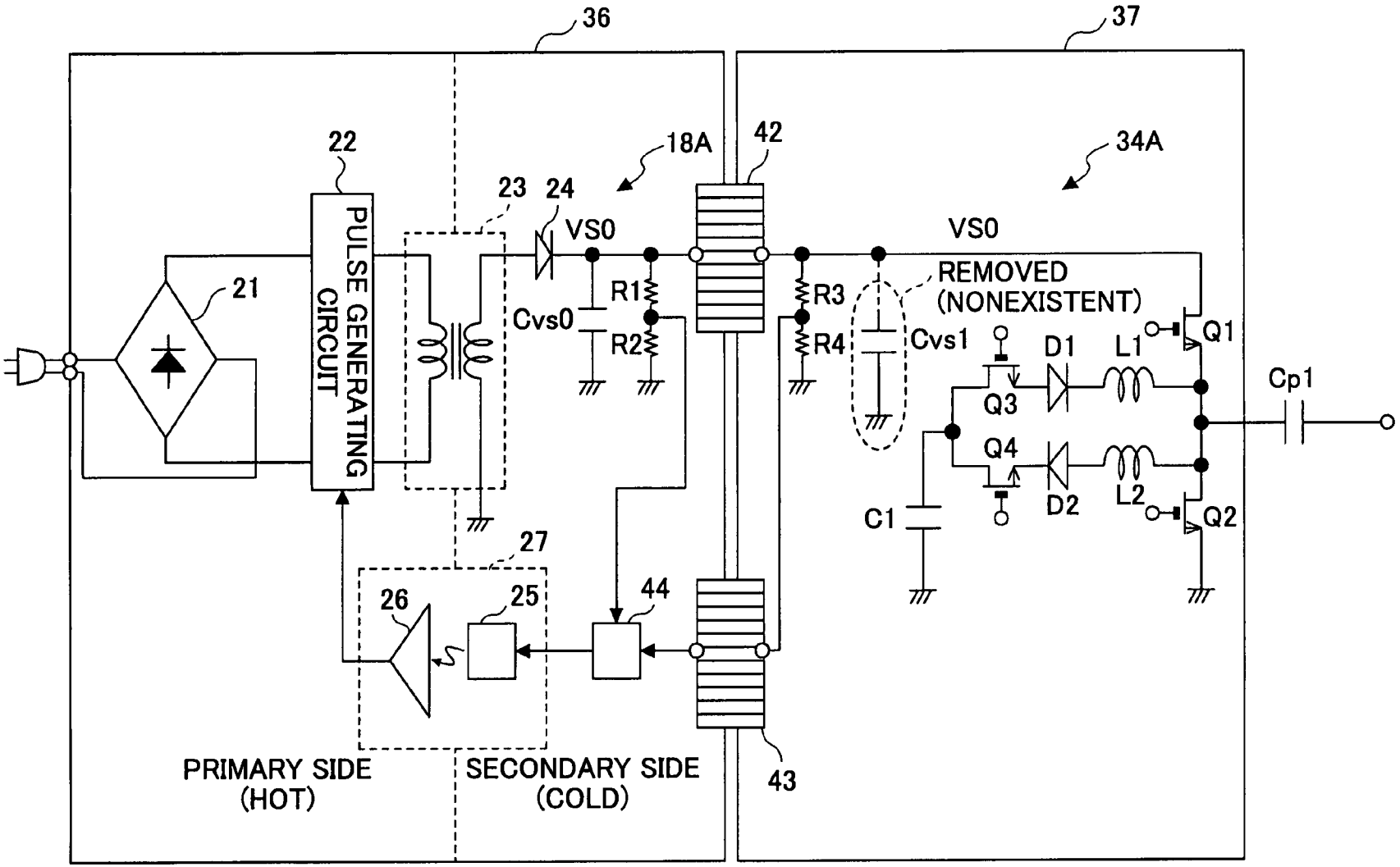
FIG. 8 is a drawing showing a variation of the first embodiment of the plasma display apparatus according to the present invention.

FIG. 8 is a drawing showing a variation of the first embodiment of the plasma display apparatus according to the present invention. In FIG. 8, the same elements as those of FIG. 7 are referred to by the same numerals, and a description thereof will be omitted.

In the configuration shown in FIG. 6 and FIG. 7, the AC/DC power supply circuit 18 and the X-electrode drive circuit 34 are implemented on the same circuit board 35, whereas in the variation shown in FIG. 8, an AC/DC power supply circuit 18A and an X-electrode drive circuit 34A are implemented separately on an AC/DC-power-supply circuit board 36 and an X-electrode-drive circuit board 37, respectively.

The AC/DC-power-supply circuit board 36 and the X-electrode-drive circuit board 37 are placed side by side, and are connected with each other through a circuit-board connector 42 and a circuit-board connector 43. The voltage VS0 generated by the AC/DC power supply circuit 18A is supplied to the X-electrode drive circuit 34A via the circuit-board connector 42. The length of the circuit-board connector 42 is substantially shorter than the length of the related-art electric cable 18*a*, so that the voltage drop of the voltage VS0 caused by an electric current running through the circuit-board connector 42 can be ignored.

The X-electrode drive circuit 34A has the same circuit configuration as the X-electrode drive circuit 14, except that the energy-supply-purpose condenser Cvs1 is removed and that resistors R3 and R4 are additionally provided. Since the voltage drop along the circuit-board connector 42 can almost completely be ignored in this case, the condenser Cvs0 provided in the AC/DC power supply circuit 18A can be utilized as an energy-supply-purpose condenser, so that there is no need to provide another energy-supply-purpose condenser in the X-electrode drive circuit 34A.

The AC/DC power supply circuit 18A has the same circuit configuration as the AC/DC power supply circuit 18, except that a switching circuit 44 is provided. The function and operation of the switching circuit 44 will later be described.

The basic circuit configuration and operation of the AC/DC power supply circuit 18A are the same as the circuit configuration and operation described in connection with FIG. 2, except that the switching circuit 44 is provided. The basic circuit configuration and operation of the X-electrode drive circuit 34A are the same as the circuit configuration and operation described in connection with FIG. 3, except that the condenser Cvs0 is used as an energy-supply-purpose condenser.

In the configuration shown in FIG. 7, the AC/DC power supply circuit 18 and the X-electrode drive circuit 34 are implemented on the same circuit board 35, whereas in the configuration shown in FIG. 8, the AC/DC power supply circuit 18A and the X-electrode drive circuit 34A are implemented separately on the AC/DC-power-supply circuit board 36 and the X-electrode-drive circuit board 37, respectively. With the provision of the AC/DC power supply circuit 18A and the X-electrode drive circuit 34A on the respective separate circuit boards, there is a merit in that no modification is necessary to the AC/DC-power-supply circuit board 36 carrying the AC/DC power supply circuit 18A even when modification is made to the X-electrode drive circuit 34A.

Various standards are defined for industrial products. The UL standard, for example, is provided by the UL that is a safety testing organization in the United States that performs an inspection and test relating to the safety of commercial products for the benefit of the public. The UL sets a standard relating to the danger of fire and electric shock caused by products, performs inspections and tests for individual products, and allows a UL mark to be attached to the products that passed its inspections and tests. In order to obtain a UL-standard approval for the AC/DC power supply circuit 18 that is implemented on the circuit board 35, there is a need to submit the entirety of the circuit board 35 for inspection and to request inspections and tests to be conducted. If modification is made to the X-electrode drive circuit 34 on the circuit board 35 after the approval is obtained, such modification is considered as a modification to the circuit board 35, so that a further inspection will need to be conducted for the entirety of the circuit board 35.

With the configuration shown in FIG. 8, on the other hand, the AC/DC power supply circuit 18A and the X-electrode drive circuit 34A are provided separately on the AC/DC-power-supply circuit board 36 and the X-electrode-drive circuit board 37, respectively, so that no modification is necessary to the AC/DC-power-supply circuit board 36 carrying the AC/DC power supply circuit 18A even when modification is made to the X-electrode drive circuit 34A. Accordingly, once an approval is obtained for the AC/DC-power-supply circuit board 36, there is no need to request an approval again, no matter what modification is thereafter made to the X-electrode drive circuit.

Moreover, the configuration shown in FIG. 8 is provided with the resistors R3 and R4, which serve as a voltage detection circuit in the X-electrode drive circuit 34A. The voltage VS0 that appears between the opposite ends of the smoothing condenser Cvs0 is divided by the resistors R3 and R4. The divided voltage is supplied to the optical coupling unit 27 via the circuit-board connector 43 and the switching circuit 44. In the optical coupling unit 27, the light-emission device 25 emits light with the intensity responsive to the divided voltage level. The light-detection device 26 receives light from the light-emission device 25, and supplies a signal responsive to the intensity of the received light to the pulse generating circuit 22. The pulse generating circuit 22 controls the generation of the pulses in response to the signal from the light-detection device 26. This feedback control serves to adjust the voltage between the opposite ends of the smoothing condenser Cvs0 to a predetermined voltage (i.e., to the sustain discharge voltage VS0).

Since the voltage VS0 to be controlled is used in the X-electrode drive circuit 34A, it is preferable to perform the feedback control based on the voltage level that is detected on the X-electrode-drive circuit board 37 where the X-electrode drive circuit 34A is implemented (i.e., where the controlled voltage is actually used). Through such feedback control, it becomes possible to set the voltage VS0 more accurately. The resistors R3 and R4 described above are provided to detect the voltage level of the voltage VS0 (or, more accurately, the divided voltage level) on the X-electrode-drive circuit board 37.

The switching circuit 44 selects an input from the X-electrode-drive circuit board 37 during the normal operation in which the plasma display apparatus is used by a user, and the selected input is supplied to the optical coupling unit 27. The setting of the switching circuit 44 may be changed in response to a control signal applied to the switching circuit 44 according to need, so that the voltage level divided by the resistors R1 and R2 is selected for provision to the optical coupling unit 27. The resistors R1 and R2 are not necessary for the purpose of the normal operation in which the plasma display apparatus is used by a user. Unless the resistors R1 and R2 are provided, however, an operation test cannot be conducted with the AC/DC-power-supply circuit board 36 alone.

In the AC/DC power supply circuit 18A of FIG. 8, the resistors R1 and R2 are provided on the AC/DC-power-supply circuit board 36, and provision is made such that the switching circuit 44 allows feedback control to be performed based on the voltage detected by the resistors R1 and R2. With this provision, it is possible to perform an operation test for the AC/DC power supply circuit 18A even if the AC/DC-power-supply circuit board 36 is provided alone without a connection to the X-electrode-drive circuit board 37.

Figure 9:
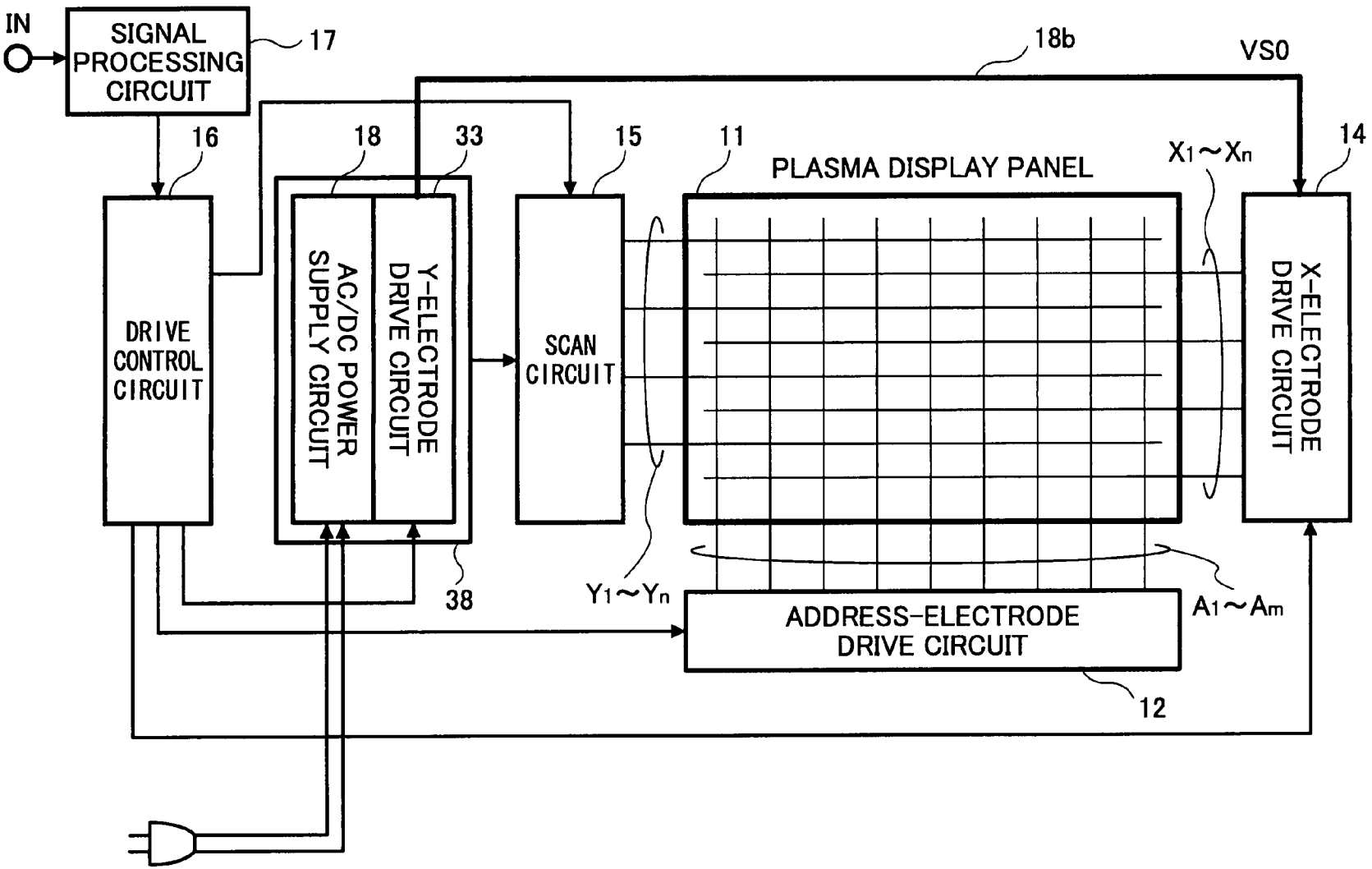
FIG. 9 is a block diagram showing a main portion of a second embodiment of the plasma display apparatus according to the present invention.

FIG. 9 is a block diagram showing a main portion of a second embodiment of the plasma display apparatus according to the present invention. A plasma display apparatus shown in FIG. 9 includes a plasma display panel 11, an address-electrode drive circuit 12, a Y-electrode drive circuit 33, an X-electrode drive circuit 14, a scan circuit 15, a drive control circuit 16, a signal processing circuit 17, and an AC/DC power supply circuit 18. In FIG. 9, the same elements as those of FIG. 1 are referred to by the same numerals, and a description thereof will be omitted.

In the plasma display apparatus shown in FIG. 9, a Y-electrode drive circuit 33 is provided in place of the Y-electrode drive circuit 13, and the Y-electrode drive circuit 33 and the AC/DC power supply circuit 18 are implemented on the same circuit board (print circuit board) 38. The provision of the Y-electrode drive circuit 33 and the AC/DC power supply circuit 18 on the same circuit board 38 eliminates the need to handle and store an electric cable that supplies the sustain discharge voltage VS0 to the Y-electrode drive circuit 33.

In the configuration shown in FIG. 1, the voltage VS0 is supplied from the AC/DC power supply circuit 18 to the X-electrode drive circuit 14 via the electric cable 18*a*, and is further supplied from the X-electrode drive circuit 14 to the Y-electrode drive circuit 13 via the electric cable 18*b*. In the configuration shown in FIG. 9, the voltage VS0 is first supplied from the AC/DC power supply circuit 18 to the Y-electrode drive circuit 33, and is then supplied from the Y-electrode drive circuit 33 to the X-electrode drive circuit 14 via the electric cable 18*b*.

The configuration and operation of the plasma display panel 11, the address-electrode drive circuit 12, the X-electrode drive circuit 14, the scan circuit 15, the drive control circuit 16, and the signal processing circuit 17 shown in FIG. 9 are the same as the configuration and operation described in connection with FIG. 1.

Figure 10:
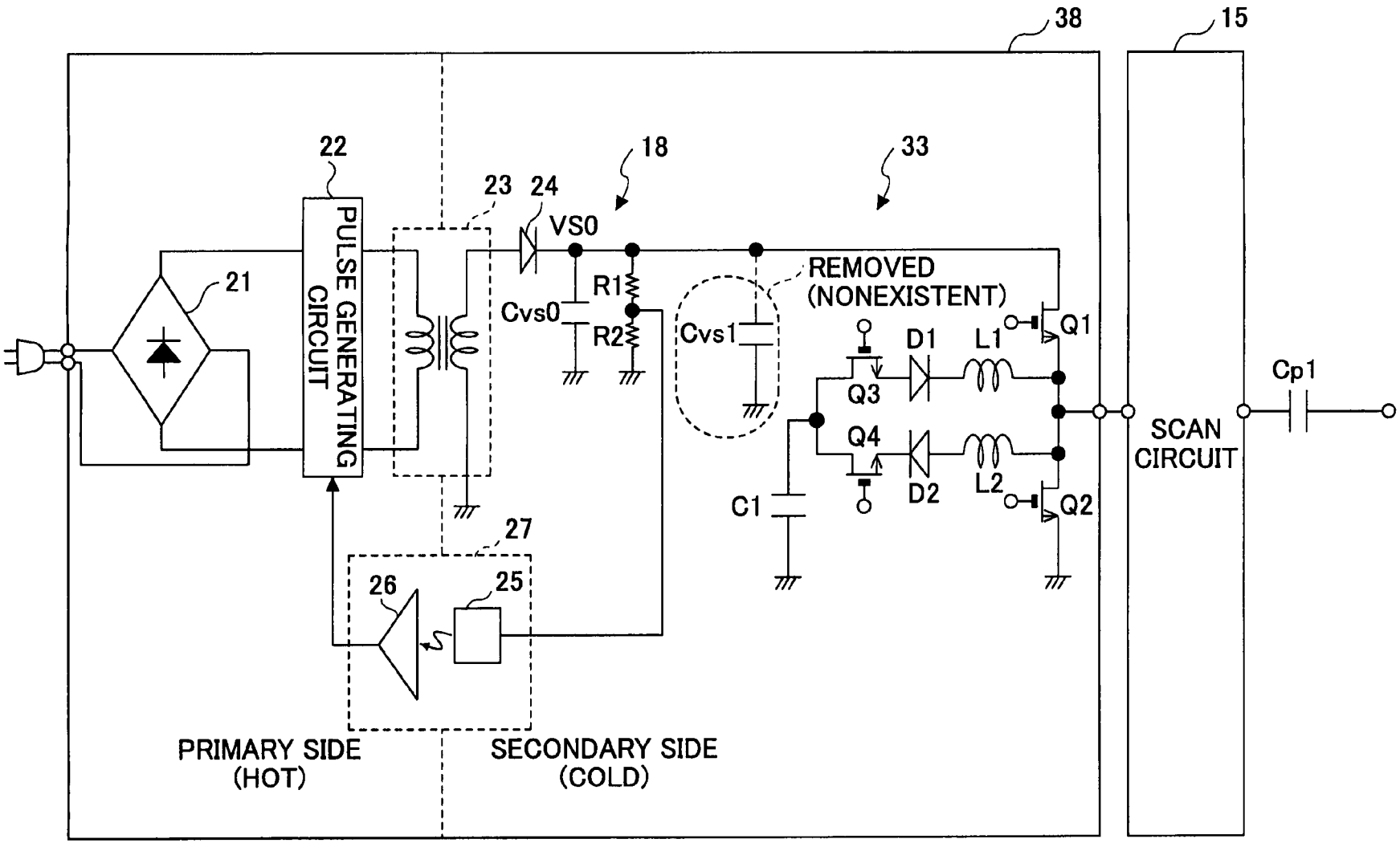
FIG. 10 is a drawing showing a Y-electrode drive circuit and an AC/DC power supply circuit implemented on the same circuit board.

FIG. 10 is a drawing showing the Y-electrode drive circuit 33 and the AC/DC power supply circuit 18 implemented on the circuit board 38. In FIG. 10, the same elements as those of FIG. 4 are referred to by the same numerals, and a description thereof will be omitted.

Since the AC/DC power supply circuit 18 and the Y-electrode drive circuit 33 are implemented on the same circuit board 38, the voltage VS0 generated by the AC/DC power supply circuit 18 is supplied to the Y-electrode drive circuit 33 via printed wiring on the circuit board 38. The length of the printed wiring is short, so that the voltage drop of the voltage VS0 caused by an electric current running through the printed wiring can be ignored.

In the related-art configuration shown in FIG. 1, the Y-electrode drive circuit 13 and the X-electrode drive circuit 14 have the same circuit configuration for their sustain circuit portions for performing sustain discharge. Namely, the circuit configuration shown in FIG. 3 that shows a portion corresponding to the sustain circuit for generating sustain discharge that is included in the X-electrode drive circuit 14 is identical to the configuration of the sustain circuit of the Y-electrode drive circuit 13.

The Y-electrode drive circuit 33 shown in FIG. 10 according to the present invention has the same circuit configuration as the related-art Y-electrode drive circuit 13, except that the energy-supply-purpose condenser Cvs1 is removed. Since the voltage drop along the printed wiring can almost completely be ignored in this case, the condenser Cvs0 provided in the AC/DC power supply circuit 18 can be utilized as an energy-supply-purpose condenser, so that there is no need to provide another energy-supply-purpose condenser in the Y-electrode drive circuit 33.

The circuit configuration and operation of the AC/DC power supply circuit 18 are the same as the circuit configuration and operation described in connection with FIG. 2. The circuit configuration and operation of the Y-electrode drive circuit 33 relating to the sustain discharge are the same as the circuit configuration and operation described in connection with FIG. 3, except that the condenser Cvs0 is used as an energy-supply-purpose condenser.

Further, the transformer 23 transmits an electric power from the primary side to the secondary side via changes in magnetic flux, so that the input side and output side of the transformer 23 are not electrically connected with each other (i.e., not directly connected through an electrical conductor).

Also, the optical coupling unit 27 comprised of the light-emission device 25 and the light-detection device 26 transmits information from the input side to the output side via changes in light intensity, so that the input side and output side are not electrically connected with each other (i.e., not directly connected through an electrical conductor). In this manner, the primary side (hot side) and the secondary side (cold side) are electrically insulated from each other.

Figure 11:
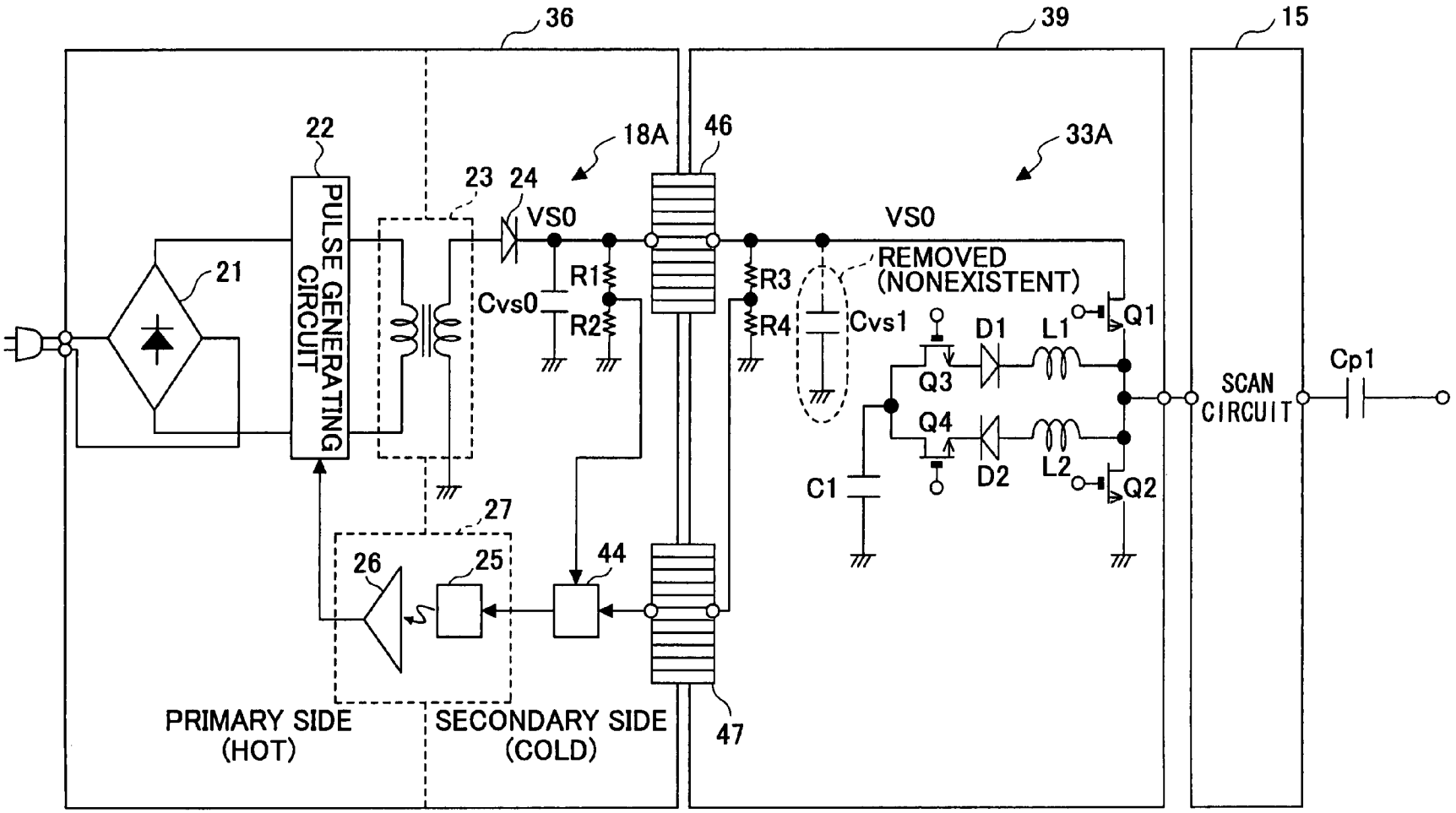
FIG. 11 is a drawing showing a variation of the second embodiment of the plasma display apparatus according to the present invention.

FIG. 11 is a drawing showing a variation of the second embodiment of the plasma display apparatus according to the present invention. In FIG. 11, the same elements as those of FIG. 10 are referred to by the same numerals, and a description thereof will be omitted.

In the configuration shown in FIG. 9 and FIG. 10, the Y-electrode drive circuit 33 and the AC/DC power supply circuit 18 are implemented on the same circuit board 38, whereas in the variation shown in FIG. 11, an AC/DC power supply circuit 18A and a Y-electrode drive circuit 33A are implemented separately on an AC/DC-power-supply circuit board 36 and a Y-electrode-drive circuit board 39, respectively.

The AC/DC-power-supply circuit board 36 and the Y-electrode-drive circuit board 39 are placed side by side, and are connected with each other through a circuit-board connector 46 and a circuit-board connector 47. The voltage VS0 generated by the AC/DC power supply circuit 18A is supplied to the Y-electrode drive circuit 33A via the circuit-board connector 46. The length of the circuit-board connector 46 is short, so that the voltage drop of the voltage VS0 caused by an electric current running through the circuit-board connector 46 can be ignored.

The Y-electrode drive circuit 33A has the same circuit configuration as the Y-electrode drive circuit 13, except that the energy-supply-purpose condenser Cvs1 is removed and that resistors R3 and R4 are additionally provided. Since the voltage drop along the circuit-board connector 46 can almost completely be ignored in this case, the condenser Cvs0 provided in the AC/DC power supply circuit 18A can be utilized as an energy-supply-purpose condenser, so that there is no need to provide another energy-supply-purpose condenser in the Y-electrode drive circuit 33A.

The AC/DC power supply circuit 18A is the same circuit as the AC/DC power supply circuit 18A described in connection with FIG. 8, and has the same circuit configuration as the related-art AC/DC power supply circuit 18, except that the switching circuit 44 is provided. The basic circuit configuration and operation of the sustain circuit of the Y-electrode drive circuit 33A are the same as the circuit configuration and operation described in connection with FIG. 3, except that the condenser Cvs0 is used as an energy-supply-purpose condenser.

In the configuration shown in FIG. 10, the AC/DC power supply circuit 18 and the Y-electrode drive circuit 33 are implemented on the same circuit board 38, whereas in the configuration shown in FIG. 11, the AC/DC power supply circuit 18A and the Y-electrode drive circuit 33A are implemented separately on the AC/DC-power-supply circuit board 36 and the Y-electrode-drive circuit board 39, respectively. Accordingly, the same merits as those described in connection with FIG. 8 are provided with respect to circuit modification and standard approvals.

Further, in the configuration shown in FIG. 11, the resistors R3 and R4 are provided to detect the voltage level of the voltage VS0 (or, more accurately, the divided voltage level) on the Y-electrode-drive circuit board 39. The switching circuit 44 selects a voltage from the Y-electrode-drive circuit board 39 during the normal operation in which the plasma display apparatus is used by a user, and the selected voltage is supplied to the optical coupling unit 27. On the other hand, the switching circuit 44 selects a voltage level from the resistors R1 and R2 in the situation in which the AC/DC-power-supply circuit board 36 is provided alone without a connection to the Y-electrode-drive circuit board 39, thereby making it possible to perform an operation test on the AC/DC power supply circuit 18A alone. These advantages are the same as the merits described with respect to the configuration shown in FIG. 8.

Further, the present invention is not limited to these embodiments, but various variations and modifications may be made without departing from the scope of the present invention.

The present application is based on Japanese priority application No. 2006-187100 filed on Jul. 6, 2006, with the Japanese Patent Office, the entire contents of which are hereby incorporated by reference.

What is claimed is:

1. A plasma display apparatus, comprising:

a display panel in which display cells are constituted at least by a set of electrodes including first electrodes extending in a first direction, second electrodes extending in the first direction, and third electrodes extending in a second direction perpendicular to the first direction;

a first drive circuit configured to drive the first electrodes;

a second drive circuit configured to drive the second electrodes;

a third drive circuit configured to drive the third electrodes in conjunction with successive scanning of the first electrodes; and a power-supply circuit configured to generate a DC voltage based on an AC voltage and to supply the DC voltage to the first drive circuit and the second drive circuit;

a first print circuit board on which the power-supply circuit is implemented;

a second print circuit board on which a given drive circuit that is one of the first drive circuit and the second drive circuit is implemented, wherein the first print circuit board and the second print circuit board are placed side by side and connected via a circuit-board connector;

a first voltage detection circuit implemented on the first print circuit board and configured to detect an output voltage of the power-supply circuit;

a second voltage detection circuit implemented on the second print circuit board and configured to detect the output voltage of the power-supply circuit; and a switching circuit implemented on the first print circuit board and configured to select one of an output of the first voltage detection circuit and an output of the second voltage detection circuit for provision as a feedback to the power-supply circuit.

2. The plasma display apparatus as claimed in claim 1, wherein the given drive circuit is a sustain circuit for generating sustain discharge in the display panel, and the power-supply circuit is a power-supply-voltage generating circuit for generating a power-supply voltage for the sustain discharge.

* * * * *